US007677170B2

(12) United States Patent
Hoier et al.

(10) Patent No.: US 7,677,170 B2
(45) Date of Patent: Mar. 16, 2010

(54) PLACEMENT AND REMOVAL DEVICE OF A DOCTOR BLADE IN A PRINTING SCREEN CYLINDER

(75) Inventors: Günther Hoier, Veitshöchheim (DE); Matthias Gygi, Montreux (CH); Eric Wagner, Preverenges (CH)

(73) Assignee: KBA-Giori S.A., Lausanne (CH)

( * ) Notice: Subject to any disclaimer, the term of this patent is extended or adjusted under 35 U.S.C. 154(b) by 360 days.

(21) Appl. No.: 11/578,225

(22) PCT Filed: Apr. 19, 2005

(86) PCT No.: PCT/IB2005/001115

§ 371 (c)(1),
(2), (4) Date: Sep. 20, 2007

(87) PCT Pub. No.: WO2005/102699

PCT Pub. Date: Nov. 3, 2005

(65) Prior Publication Data

US 2008/0271631 A1 Nov. 6, 2008

(30) Foreign Application Priority Data

Apr. 22, 2004 (EP) ..... 04009515

(51) Int. Cl.
*B41F 15/42* (2006.01)

(52) U.S. Cl. ..... 101/120; 101/116; 101/479

(58) Field of Classification Search ..... 101/116, 101/119, 120, 479

See application file for complete search history.

(56) References Cited

U.S. PATENT DOCUMENTS 5,592,313 A 1/1997 Hart
5,992,313 A 11/1999 Zimmer

FOREIGN PATENT DOCUMENTS

EP 0 463 699 A1 1/1992
EP 0 612 615 A1 8/1994
EP 0 860 275 A1 8/1998

*Primary Examiner*—Leslie J Evanisko
(74) *Attorney, Agent, or Firm*—Crompton, Seager & Tufte, LLC

(57) ABSTRACT

The present invention relates to a device for placing and removing a doctor blade in a printing screen cylinder mounted on a printing machine having a support mounted on the frame of the machine in the continuation of the cylinder, and a track mounted on the support and designed to allow a slider to move parallel only to the axis of the cylinder between a first limit position situated outside of the cylinder and a second limit position situated inside the cylinder facing the working position of the doctor blade.

18 Claims, 3 Drawing Sheets

PLACEMENT AND REMOVAL DEVICE OF A DOCTOR BLADE IN A PRINTING SCREEN CYLINDER

FIELD

There is described a placement and removal device of a doctor blade in a screen printing impression cylinder mounted on a printing machine. The device has a support fixed to the frame of the machine in the extension of the cylinder on which a slide is mounted in a manner that enables it to pivot about an axis parallel to the axis of the cylinder. The track is provided for enabling a slider to be displaced only parallel to the axis. The slider is designed for enabling it, in a first limit position situated on the outside of the cylinder, to rise in order to remove the doctor blade and, in a second limit position inside the cylinder, to be placed in front of the working position of the doctor blade.

BACKGROUND

When screen printing with a printing machine, for example when printing banknotes by this method, use is made of one or more hollow cylinders, whose lateral surface consists of a mesh of natural or synthetic fibers. A varnish is used to block up those holes of the mesh which are not part of the image to be printed. A printing ink is fed into the inside of the cylinder and a doctor blade contacts the inside surface of the mesh and pushes this ink through the open holes of the mesh. Usually, when the screen printing cylinder is placed on the machine, one person stands at one end of the screen and inserts the doctor blade into the body of the cylinder. Another person stands at the other end of the cylinder and catches the free end of the doctor blade and with a combined action the two people position the blade in its bearings. To remove the blade, two people carry out the process in reverse. Consequently, both placement and removal of the doctor blade require two people to be present. There is also the risk of the blade touching the mesh during these operations and destroying it. During removal the person pulling the doctor blade towards himself is obliged to pick it up at an intermediate point and inevitably gets ink on himself.

U.S. Pat. No. 5,592,313 provides two ways of avoiding these operations. One way is to have a rail attached to the doctor blade. The rail is engaged in a track situated at one end of the cylinder. The rail/blade assembly is moved parallel to the cylinder axis until it reaches a second track at the other end of the cylinder. The rail/blade assembly is then laid by a vertical movement on two bearings which may pivot about a vertical axis or may be vertically movable. Another way is for the bearings to be in the form of two tracks that move vertically when placing the doctor blade in the working position.

EP-A-0 463 699 also provides a way of placing and removing very long doctor blades. A mechanism of gears, belts and cranks is used to place and remove an assembly comprising the blade, a moving carriage and a guide. The fixing means (bearings) of the blade pivot about the blade. The blade turns on its axis to position the angled inlet of the feeder pipe of the doctor blade.

SUMMARY

It is an object of the present invention to provide a doctor blade placement and removal device that is simple and can be handled by one person while the bearings of the blade are fixed.

The device according to the invention is characterized in that said slider is provided with assembly and disassembly means engaging with mating means on the blade in order to make it possible to mount the blade on the slider or to remove the blade from the slider in said first and second limit positions, and in that said track pivots on said support about an axis parallel to the axis of said cylinder in such a way that, in said second limit position of the slider, the blade can be placed in the working position or withdrawn from the working position by pivoting the track and slider together about the axis.

The advantage of this device is that one person can place the doctor blade and remove it without endangering the mesh of the screen printing cylinder and without getting ink on himself.

The device is simple and easy to fit. Precise dimensions and positions are necessary but are within the scope of a person skilled in the art, so that the doctor blade faces its working position and by pivoting the track and slider is laid on its bearings or removed. The positions of the doctor blade bearings are fixed during these operations: no additionally checking or adjustments are necessary to ensure that the bearings are accurately in position.

In the dependent claims, technical features of different components of the device are claimed.

Thus, the selected track consists of four pairs of rollers, the rollers of each pair being superposed, and sufficient space being left to allow the corresponding passage of the slider which is trapped in this track except as regards its movement parallel to the cylinder axis. It is also possible to use a track with roller bearings or ball bearings or even a track without such components but with lubricated sliding. Alternatively, the slider may be provided with means such as rollers, roller bearings or ball bearings while the track may or may not also have these. The person skilled in the art will decide based on the desired result and of course on the dimensions and weight of the doctor blade and of the slider.

BRIEF DESCRIPTION

The invention will be described with the aid of the accompanying drawing.

DETAILED DESCRIPTION

Figure 1:
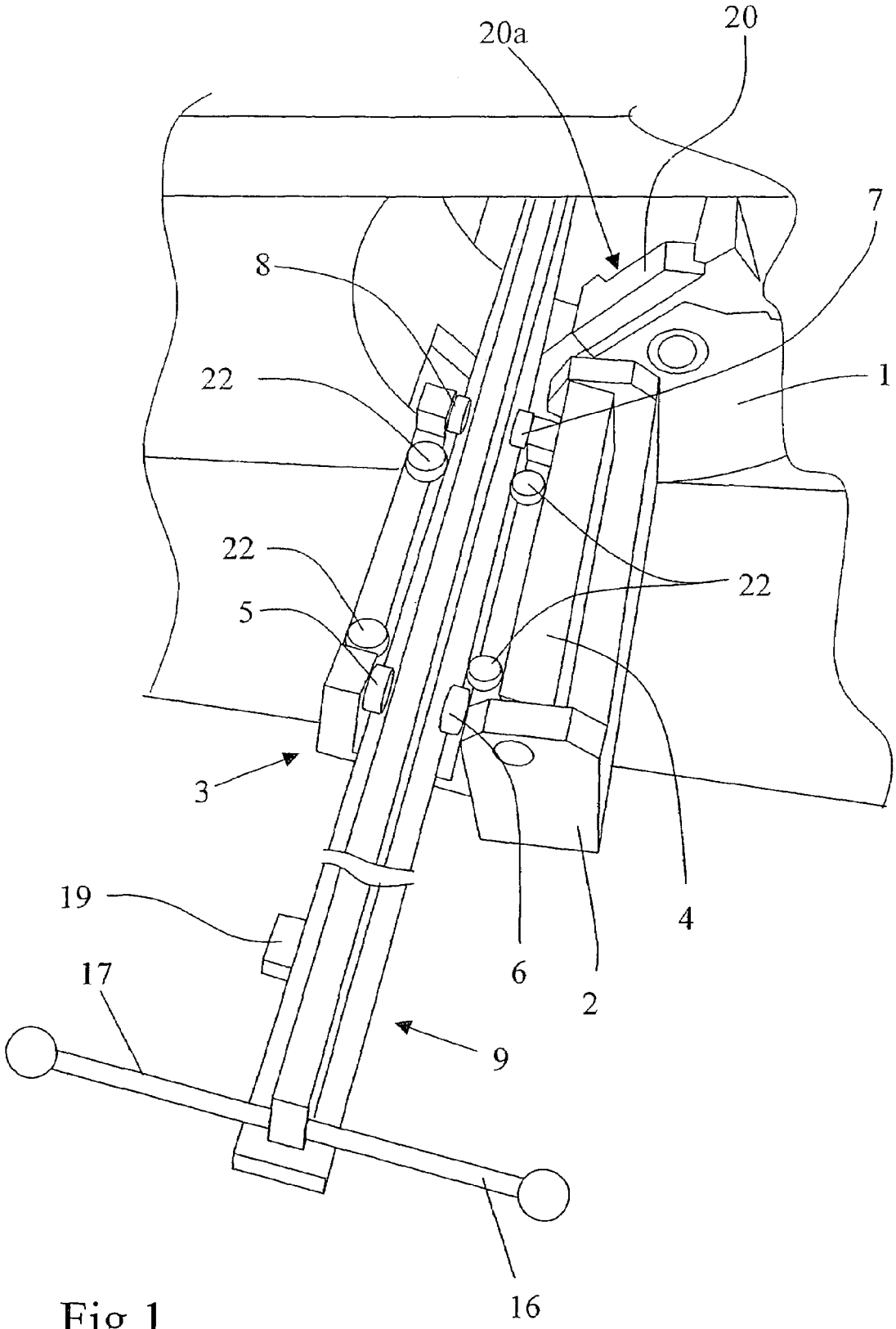
FIG. 1 is a schematic partial view in perspective of the device according to the invention.

On a machine frame 1 (shown schematically and without the screen printing cylinder) a support 2 is mounted in the continuation of the cylinder. Mounted on this support is a track 3 pivoting about a hinge 4. The track comprises four pairs of rollers 5, 6, 7, 8, the rollers of each pair being superposed and separated so that the corresponding part of a slider 9 can pass between them. Thus, the slider 9 has freedom to move only parallel to the axis of the cylinder.

The slider 9 consists of a T-section bar. The arms of the head of this bar engage in the spaces between the rollers of each pair 5 to 8 and the bar 9 is held and guided by-these rollers. Two plates 11, 12 are fixed to the leg of the bar, each with a stud 10, 13 (FIG. 2). These studs engage in two slots 14, 15 in the form of bayonet slots situated on the back of the doctor blade 21 for quick assembly of the blade 21 and slider 9. Other similar means can be used for quick assembly and disassembly of these two elements. The end of the slider 9 remote from the screen is provided with two handles in the form of rods 16, 17 for manipulating the slider 9. These rods 16, 17 are perpendicular to the axis of the slider 9 and in this particular case form an angle of 180°. They could also form an angle of less than 180°. Depending on the combined weight and dimensions of the slider, doctor blade and track, one rod may be sufficient. On the slider 9 an adjustable or nonadjustable end-of-travel stop 19 (FIG. 1) defines the maximum permitted movement of the slider into the cylinder. A second stop (not shown) may be provided at the other end of the slider to prevent the slider 9 (FIG. 2) accidentally coming off the track 3 in the limit position of placement or removal of the doctor blade 21 on the slider 9.

For lateral guidance of the slider 9 the track may also be fitted with two or more additional rollers 22.

Figure 2:
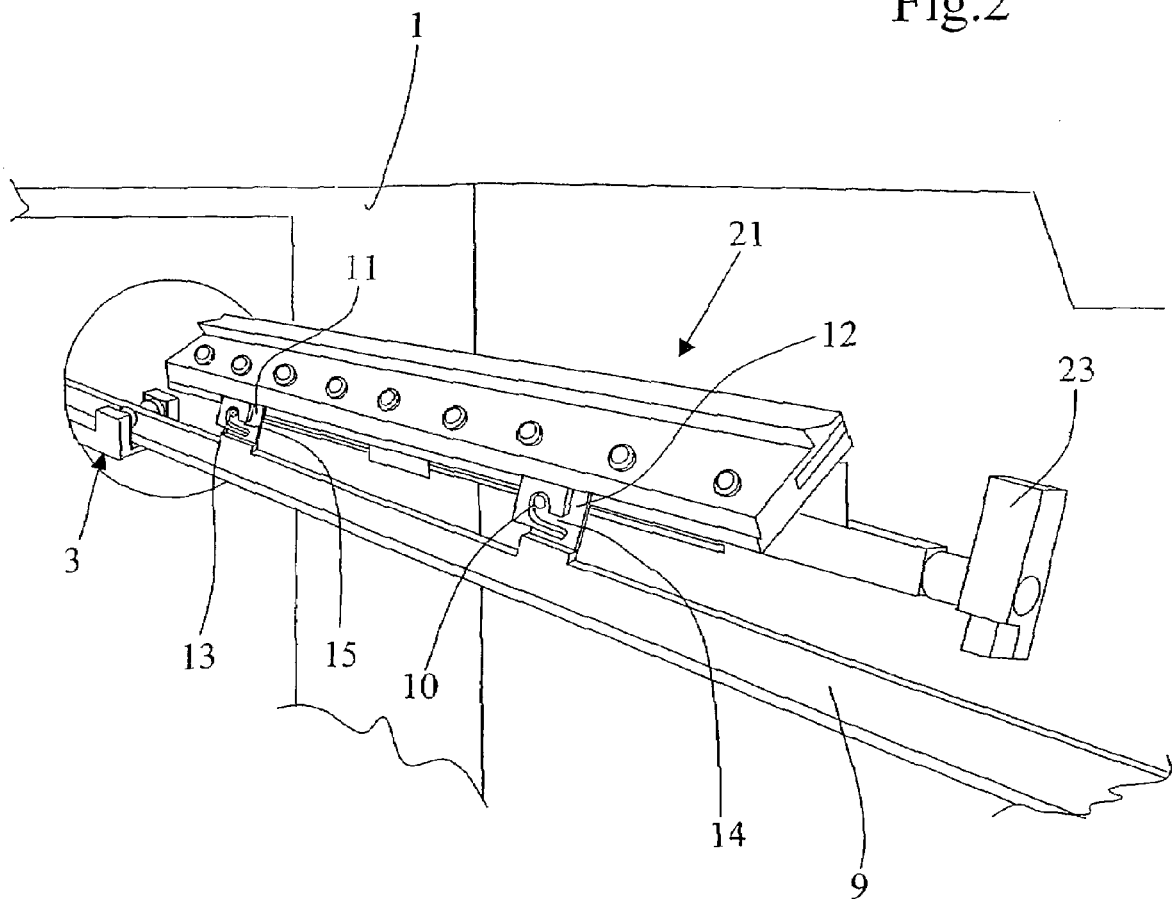
FIG. 2 is a schematic partial view in perspective of the device with the doctor blade before its insertion into the screen.
Figure 3:
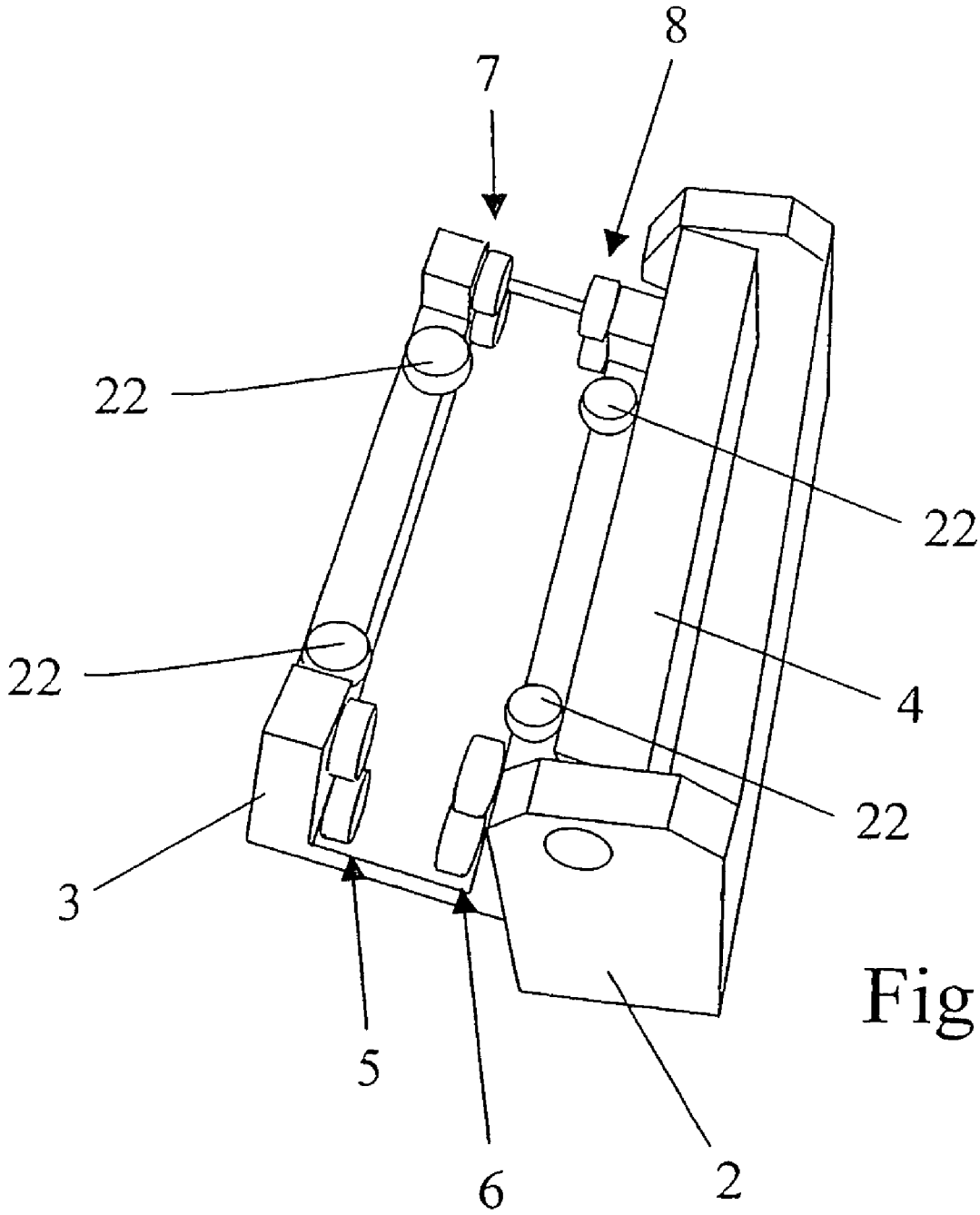
FIG. 3 is a schematic view in perspective of the track with its support.

As illustrated in FIG. 1, the support 2 with the track 3 is mounted in the continuation of the cylinder close to one of the bearings (which has been given the overall reference 20) designed to receive the doctor blade 21, but can also be mounted on the diametrically opposite point or some other point, the essential point being that it must be possible to position the blade 21 correctly relative to the bearings 20 when placing or removing the blade 21.

Placement of the doctor blade 21 will now be explained. The slider 9 is pulled out of the frame 1, its end being engaged and held in the track 3 (FIG. 2). The blade 21 is mounted on the slider by engaging the studs 10, 13 in the slots 14, 15. The rods 16, 17 are then gripped so as to push the slider 9 into the cylinder until it meets the end-of-travel stop 19, where the doctor blade 21 is facing its working position. The two rods 16, 17 are used to pivot the track 3, slider 9 and blade 21 together about the hinge 4 until the ends of the blade fit into the bearings provided on the frame 1. The two ends of the blade 21 have two supports 23 having specific shapes and dimensions. These supports 23 are provided with appropriate fixing means (not shown) allowing the operator to lock the doctor blade 21 by its supports 23 in the bearings 20. The bearings 20 mate with them in shape and dimensions to allow correct and precise positioning of the blade. Each bearing 20 comprises in particular a housing 20*a* (partly visible in FIG. 1) which essentially corresponds in shape and dimensions to the shape and dimensions of the supports 23 of the blade 21. Both bearings 20 are fixed to the frame 1 and do not move during blade placement and removal operations. The studs are disengaged by continuing the pivoting and pulling the slider 9 a few centimeters in the outward direction. The track 3 and slider 9 are pivoted together in the opposite direction and the slider 9 is pulled out. During printing the slider 9 is withdrawn completely from the track 3, the blade 21 being held in its bearings 20 by means of the supports 23. To withdraw the blade 21 the operation is done more or less in reverse. After unlocking the supports 23 of the bearings 20, the slider 9 is pushed along to the stop 19, the track 3 and slider are pivoted together, the studs 10, 13 are engaged in the slots 14, 15, the assembly is pivoted in the other direction, and the slider is pulled out with the doctor blade 21. One person can place the doctor blade on the slider and place it in the bearings and remove the slider in a few seconds. Likewise for the reverse operation.

As mentioned earlier, the track 3, the slider 9 and the quick-assembly means can be modified without departing from the scope of the invention.

In a preferred embodiment of the invention, to ensure precise positioning of the doctor blade, a second support with a hinged track identical to the elements already described are mounted at the other end of the machine frame. Before reaching the end of its travel, the end of the slider thus engages in the second track, so that the slider and blade together are held securely during placement or removal of the blade.

The invention claimed is:

1. A device for placing and removing a doctor blade in a screen printing cylinder mounted on a printing machine, the device comprising: a support mounted on a frame of the machine in continuation of said cylinder, and a track mounted on said support and designed to allow a slider to move parallel only to the axis of said cylinder between a first limit position situated outside of said cylinder and a second limit position situated inside said cylinder facing the working position of the doctor blade, wherein said slider is provided with a quick assembly and disassembly system for mounting of the doctor blade on the slider or removing of the doctor blade from the slider in said first and second limit positions, and wherein said track pivots on said support about an axis parallel to the axis of said cylinder in such a way that, in said second limit position of the slider, the doctor blade can be placed in the working position or withdrawn from the working position by pivoting the track and slider together about the axis.

2. The device as claimed in claim 1, wherein said slider is provided with a handle for moving the slider parallel to the axis of said cylinder and for pivoting the track and slider together.

3. The device as claimed in claim 2, wherein the handle of the slider includes two rods perpendicular to the axis of the slider and situated at the end of the slider remote from said cylinder, the rods forming an angle of between 60° and 180°.

4. The device as claimed in claim 2, wherein the handle of the slider includes at least one rod perpendicular to the axis of the slider and situated at the end of the slider remote from said cylinder.

5. The device as claimed in claim 4, wherein the handle of the slider includes two rods perpendicular to the axis of the slider and situated at the end of the slider remote from said cylinder, the rods forming an angle of between 60° and 180°.

6. The device as claimed in claim 4, wherein the handle of the slider includes two rods perpendicular to the axis of the slider and situated at the end of the slider remote from said cylinder, the rods forming an angle of between 60° and 180°.

7. The device as claimed in claim 6, wherein the slider is provided with a stop for positioning of the slider at the two limit positions.

8. The device as claimed in claim 2, wherein the track comprises a body provided with rollers for guiding said slider.

9. The device as claimed in claim 8, wherein the track comprises four pairs of rollers located at four points of said body, on either side of said slider, the rollers of each pair being superposed, and a space being provided between them to allow a corresponding part of the slider to pass between them.

10. The device as claimed in claim 9, wherein the track is provided with at least two rollers arranged on either side of said slider for the lateral guidance of the slider.

11. The device as claimed in claim 10, wherein the slider is a T-section bar comprising a leg and a head with two arms, the means of assembly and disassembly being mounted on the leg of the T-section bar and the two arms of the head of the T-section bar being held between the superposed rollers of each pair of the track.

12. The device as claimed in claim 1, wherein the track comprises a body provided with rollers for guiding said slider.

13. The device as claimed in claim 12, wherein the track comprises four pairs of rollers located at four points of said body, on either side of said slider, the rollers of each pair being superposed, and a space being provided between them to allow a corresponding part of the slider to pass between them.

14. The device as claimed in claim 13, wherein the slider is a T-section bar comprising a leg and a head with two arms, the means of assembly and disassembly being mounted on the leg of the T-section bar and the two arms of the head of the T-section bar being held between the superposed rollers of each pair of the track.

15. The device as claimed in claim 12, wherein the track is provided with at least two rollers arranged on either side of said slider for the lateral guidance of the slider.

16. The device as claimed in claim 15, wherein the slider is a T-section bar comprising a leg and a head with two arms, the means of assembly and disassembly being mounted on the leg of the T-section bar and the two arms of the head of the T-section bar being held between the superposed rollers of each pair of the track.

17. The device as claimed in claim 12, wherein the slider is a T-section bar comprising a leg and a head with two arms, the means of assembly and disassembly being mounted on the leg of the T-section bar and the two arms of the head of the T-section bar being held between the superposed rollers of each pair of the track.

18. The device as claimed in claim 1, wherein the slider is provided with a stop for positioning of the slider at the two limit positions.

* * * * *

UNITED STATES PATENT AND TRADEMARK OFFICE

CERTIFICATE OF CORRECTION

PATENT NO. : 7,677,170 B2
APPLICATION NO. : 11/578225
DATED : March 16, 2010
INVENTOR(S) : Günther Hoier, Matthias Gygi and Eric Wagner It is certified that error appears in the above-identified patent and that said Letters Patent is hereby corrected as shown below:

On the title page item (57),
Abstract: Replace the abstract with the following:

-- There is described a placement and removal device of a doctor blade in a screen printing impression cylinder mounted on a printing machine. The device has a support fixed to the frame of the machine in the extension of the cylinder on which a slide is mounted in a manner that enables it to pivot about an axis parallel to the axis of the cylinder. The track is provided for enabling a slider to be displaced only parallel to the axis. The slider is designed for enabling it, in a first limit position situated on the outside of the cylinder, to rise in order to remove the doctor blade and, in a second limit position inside the cylinder, to be placed in front of the working position of the doctor blade. --

Column 1
Line 7-18: Replace the first paragraph with the following:

-- The present invention relates to a device for placing and removing a doctor blade in a printing screen cylinder mounted on a printing machine having a support mounted on the frame of the machine in the continuation of the cylinder, and a track mounted on the support and designed to allow a slider to move parallel only to the axis of the cylinder between a first limit position situated outside of the cylinder and a second limit position situated inside the cylinder facing the working position of the doctor blade. --

Signed and Sealed this

Fifth Day of October, 2010

David J. Kappos

David J. Kappos
*Director of the United States Patent and Trademark Office*